US007221082B2

(12) United States Patent
Jang et al.

(10) Patent No.: US 7,221,082 B2
(45) Date of Patent: May 22, 2007

(54) PANEL FOR USE IN A CATHODE RAY TUBE

(75) Inventors: Gue Chul Jang, Kyungki-do (KR); Jae Seon Kim, Kyungki-do (KR); Hyo Keun Lee, Kyungki-do (KR)

(73) Assignee: Samsung Corning Co., Ltd., Kyungki-do (KR)

( * ) Notice: Subject to any disclaimer, the term of this patent is extended or adjusted under 35 U.S.C. 154(b) by 331 days.

(21) Appl. No.: 11/034,807

(22) Filed: Jan. 14, 2005

(65) Prior Publication Data

US 2005/0156502 A1 Jul. 21, 2005

(30) Foreign Application Priority Data

Jan. 15, 2004 (KR) ..... 10-2004-0003022

(51) Int. Cl.
*H01J 29/86* (2006.01)

(52) U.S. Cl. ..... 313/477 R; 313/461

(58) Field of Classification Search ..... 313/461, 313/477 R; 220/2.1 A, 2.3 A
See application file for complete search history.

(56) References Cited

U.S. PATENT DOCUMENTS

| | | | | |
|---|---|---|---|---|
| 6,566,802 | B1 * | 5/2003 | Jeong | 313/477 R |
| 2003/0214221 | A1 * | 11/2003 | Choo | 313/477 R |
| 2004/0140752 | A1 * | 7/2004 | Choi | 313/477 R |

* cited by examiner

*Primary Examiner*—Vip Patel
(74) *Attorney, Agent, or Firm*—Bacon & Thomas, PLLC

(57) ABSTRACT

A panel for use in a cathode ray tube includes a face portion for displaying picture images, a skirt portion extending backward from a perimeter of the face portion and a blend radius portion joining the skirt portion to the face portion. The panel for use in a cathode ray tube has average outside curvature radius R (mm) of the face portion which satisfies the following relationship: $R \geqq 10{,}000$; wedge rate Td/Tc of the face portion which satisfies the following relationship: $2.0 \leqq Td/Tc \leqq 2.6$; maximum compressive surface stress $\sigma C_{max}$ (MPa) of the face portion and the skirt portion which satisfies the following relationship: $-30 \leqq \sigma C_{max} \leqq -15$; and tensile bending stress σbt (MPa) at inner surface of the blend radius portion which satisfies the following relationship: $\sigma bt \leqq 10$.

2 Claims, 2 Drawing Sheets

PANEL FOR USE IN A CATHODE RAY TUBE

FIELD OF THE INVENTION

The present invention relates to a panel for use in a cathode ray tube; and more particularly, to a panel for use in a cathode ray tube which is capable of preventing breakage of a glass bulb due to tensile stress while, at the same time, accomplishing weight reduction of the glass bulb.

BACKGROUND OF THE INVENTION

As well known, a glass bulb in a cathode ray tube (CRT) used in a TV set or a computer monitor basically includes a panel through which picture images are shown, a conical funnel bonded to the back of the panel and a tubular neck bonded to an apex portion of the conical funnel. The panel is constituted by a face portion for displaying images, a skirt portion extending backward from a perimeter of the face portion and having a seal edge on its back end, and a blend radius portion integrally joining the skirt portion to the face portion. The funnel is divided into a body portion having a seal edge and a yoke portion extending backward from the body portion. The seal edge of the body portion is bonded to the seal edge of the skirt portion, and the neck is bonded to the yoke portion.

Such panel, funnel and neck are made of glass, wherein particularly the panel and the funnel are manufactured by pressing molten glass called a glass gob into predetermined dimensions and shapes. The pressed panel is cooled down by forced air draft, so that the panel receives its final form. Afterwards the panel is admitted to a pin sealing machine. On the pin sealing machine the studs (also called pin) are melted into the panel. Then, stresses present in the panel are relaxed by heat treatment in an annealing lehr and the panel goes through inspection procedure to be a product.

In the normal annealing process, the panel is cooled down to a temperature at 520° C., i.e., the annealing point, or below before being entered to the annealing lehr. The annealing point is the temperature at which most of stresses present in the panel are relaxed if the panel is kept in the annealing lehr at this temperature for about 15 minutes. The panel cooled down to the annealing point or below is conveyed through the annealing lehr whose temperature is maintained at about 520° C., and then cooled down to room temperature. It takes about 30 minutes to complete the annealing process. The stress present in the panel is classified into compressive stress and tensile stress. After the annealing process, the residual compressive stress at a surface of the panel is in the range of 0 to −3 MPa and the residual tensile stresses at inner surfaces of corner portions are equal to or less than +10 MPa (a minus sign (−) in front of a stress value indicates the compressive stress and a plus sign (+), the tensile stress). However, the normal annealing process is not suitable for a glass bulb maker, which mass-produces panels, as it lessens the productivity and increases the production cost.

Recently, conventional spherical panels have been rapidly replaced by flat panels because of customers' increasing demand for high definition and large-size screen. When compared to the spherical panels, the flat panels offer numerous advantages. For example, they can reduce image distortion, minimize eye fatigue and provide a wide range of visibility. By the way, as a cathode ray tube becomes flattened and enlarged for the flat and large-size screen, thickness and weight of a glass bulb are increased to secure its mechanical strength. The increase in weight of the glass bulb is due to the increase in weight of a flat panel, and the increase in weight of the flat panel degrades its formability and bondability resulting in a fall of glass bulb productivity.

Therefore, glass bulb makers and cathode ray tube makers have been actively carrying out researches on weight reduction of the glass bulb for improving productivity by shortening annealing time and for reducing thickness and weight of glass bulb as well as on cathode ray tube for the flat and large-size screen.

As a method for compensating for structural weakness of the glass bulb caused by its weight reduction, physical strengthening method is used to form a compressive stress layer on a surface of a panel in a thickness of about 20% of the thickness of the panel. In the physical strengthening method, the panel is thermally treated in the annealing lehr whose highest temperature is less than the annealing point, i.e., 520° C. Then, the panel is cooled down to room temperature, so that residual stresses whose levels are higher than that of the panel thermally treated by the normal annealing process are imparted thereto.

However, the physical strengthening method causes a permanent tensile stress in the panel as the panel is cooled down non-uniformly for non-uniform thickness distribution of the panel of a complicated three dimensional structure. Further, tensile stress makes glass vulnerable to a mechanical impact, so defects are easily formed in the panel having tensile stress even by a little mechanical impact. Accordingly, there is a drawback that the panel thermally treated by the physical strengthening method is readily broken due to thermal stress in a frit sealing furnace used in manufacture of a cathode ray tube. In addition, as the compressive stress value of the panel becomes higher, the tensile stresses at inner surfaces of corner portions in a diagonal direction of the panel are increased.

There has been reported no panel which is capable of satisfying requirements for weight reduction of the glass bulb and breakage prevention of the glass bulb due to residual tensile stress or membrane stress, i.e., the stress present in inner surface of corner portion of the panel thermally treated in the annealing lehr.

SUMMARY OF THE INVENTION

It is, therefore, an object of the present invention to provide a panel for use in a cathode ray tube, which is capable of preventing breakage of a glass bulb due to tensile stress.

It is another object of the present invention to provide a panel for use in a cathode ray tube, which is capable of accomplishing weight reduction in the glass bulb.

In accordance with the present invention, there is provided a panel for use in a cathode ray tube, including: a face portion for displaying picture images, the face portion having first to fourth corner portions; a skirt portion extending backward from a perimeter of the face portion; and a blend radius portion joining the skirt portion to the face portion, wherein average outside curvature radius R (mm) of the face portion satisfies the following relationship: $R \geqq 10,000$; wedge rate Td/Tc of the face portion satisfies the following relationship: $2.0 \leqq Td/Tc \leqq 2.6$; maximum compressive surface stress $\sigma C_{max}$ (MPa) of the face portion and the skirt portion satisfies the following relationship: $-30 \leqq \sigma C_{max} \leqq -15$; and tensile bending stress $\sigma bt$ (MPa) at inner surface of the blend radius portion satisfies the following relationship: $\sigma bt \leqq 10$.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

Figure 1:
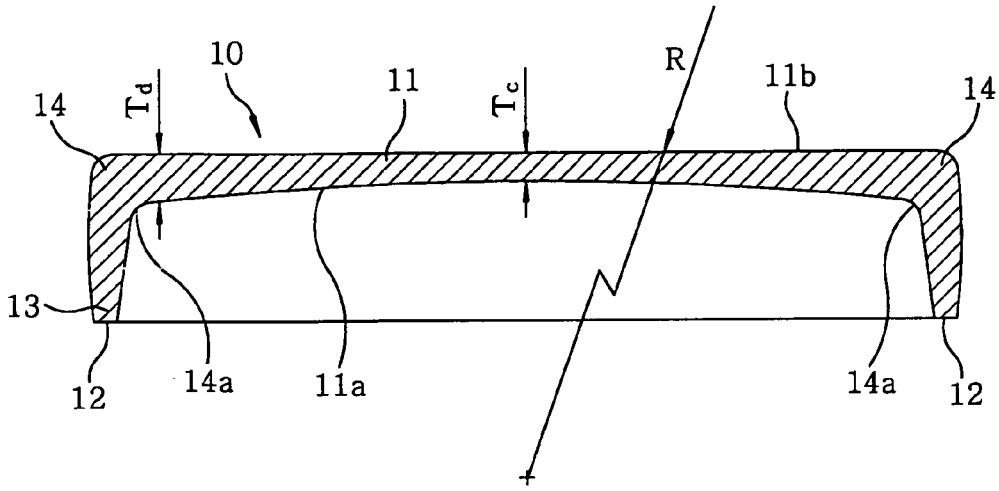
FIG. 1 is a diagonal cross sectional view of a panel for use in a cathode ray tube in accordance with the present invention.
Figure 2:
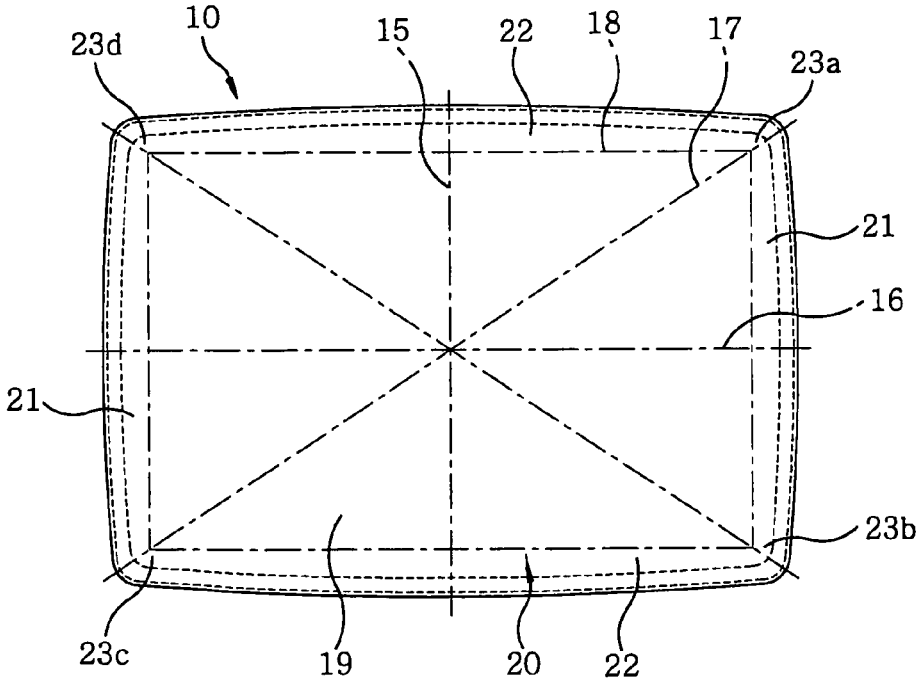
FIG. 2 presents a top view of the panel for use in a cathode ray tube in accordance with the present invention.
Figure 3:
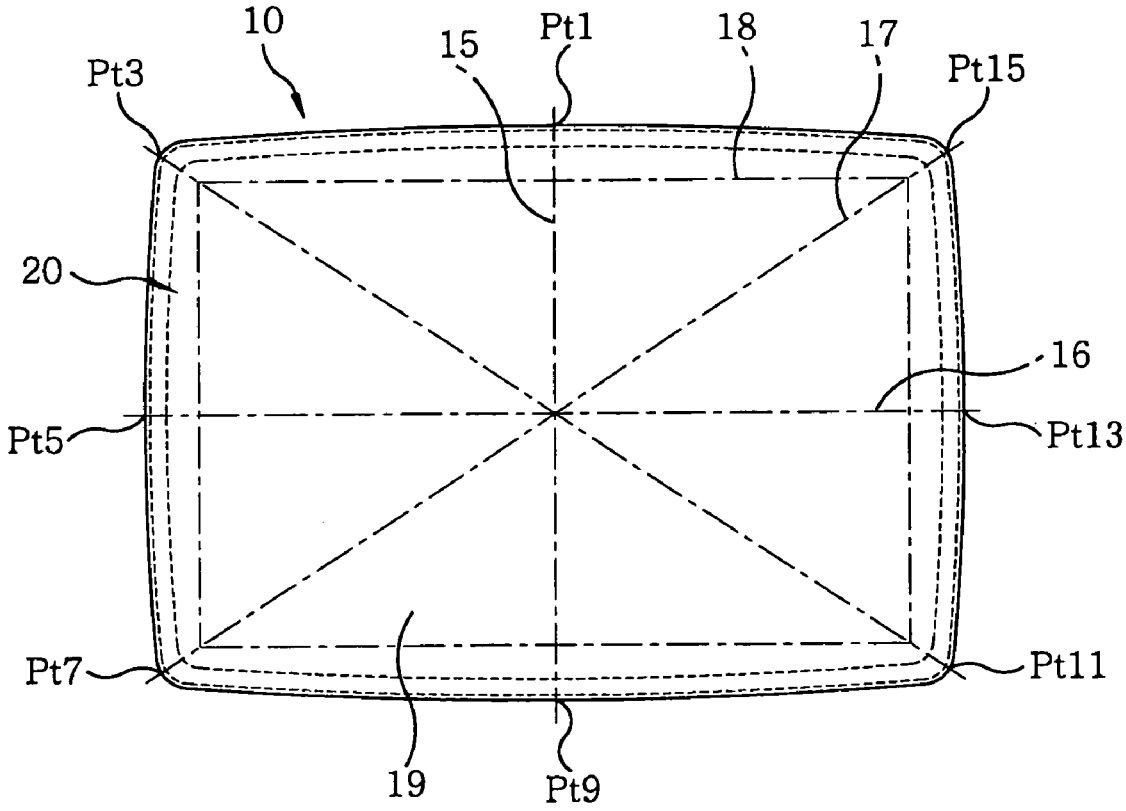
FIG. 3 offers a top view of the panel for use in a cathode ray tube in accordance with the present invention in order to define locations along a periphery thereof.

Preferred embodiments of the present invention will now be described in detail with reference to the accompanying drawings, wherein like parts appearing in FIGS. 1 to 3 are represented by like reference characters.

Referring to FIG. 1, there is illustrated a diagonal cross sectional view of a panel for use in a cathode ray tube in accordance with the present invention. The panel 10 includes a face portion 11 whose inner surface is covered with a phosphor material (not shown) to display picture images, a skirt portion 13 extending backward from a perimeter of the face portion 11 and having a seal edge 12 on its back end and a blend radius portion 14 integrally joining the skirt portion 13 to the face portion 11.

Referring to FIG. 2, there is illustrated a top view of the panel 10. The panel 10 has a shape of rectangle having a minor axis 15, a major axis 16 and diagonal axes 17. The face portion 11 is divided into a central face portion 19 serving as a useful screen 18 (or effective screen) for practically displaying images, and a peripheral face portion 20 surrounding the central face portion 19. And the peripheral face portion 20 is provided with first to fourth corner portions 23*a* to 23*d* where two opposite short skirts 21 and two opposite long skirts 22 meet.

In FIGS. 1 and 2, reference Tc represents a center face thickness, i.e., the center thickness of the faceplate 11 measured at the center of the useful screen 18; reference Td, a diagonal useful screen end thickness, i.e., a thickness of the face portion 11 at a point where an inside contour 11*a* of the face portion 11 is tangent to an inside blend radius portion 14*a* of the blend radius portion 14 in a diagonal direction; and R, an average outside curvature radius, i.e., an average value of outside curvature radii of outside contours 11*b* of the face portion 11 passing the center on the outer surface of the face portion 11 in predetermined directions, wherein the tangent point between the inside contour 11*a* of the face portion 11 and the inside blend radius portion 14*a* of the blend radius portion 14 in a diagonal direction is the thickest point of the face portion 11. Further, a wedge rate Td/Tc means a rate of the diagonal useful screen end thickness Td to the center face thickness Tc.

With the above-described construction, the panel 10 has the average outside curvature radius R (mm) of the face portion 11 which satisfies the following relationship: $R \geqq 10{,}000$; the wedge rate Td/Tc which satisfies the following relationship: $2.0 \leqq Td/Tc \leqq 2.6$; and a maximum compressive surface stress $\sigma C_{max}$ (MPa) which satisfies the following relationship: $-30 \leqq \sigma C_{max} \leqq -15$. Further, a tensile bending stress $\sigma bt$ (MPa) at the inner surface of the blend radius portion 14 satisfies the following relationship: $\sigma bt \leqq 10$; and seal edge stresses $\sigma$ (MPa) of the first to fourth corner portions 23*a* to 23*d*, the following relationship: $-3.5 \leqq \sigma \leqq 3$.

In a panel subjected to weight reduction, the compressive surface stress should be so high as to compensate for a structural weakening of the panel caused by its weight reduction. More particularly, in order to accomplish weight reduction rate as high as 10~20% at center of the face portion, the compressive surface stress $\sigma C_{max}$ (MPa) should satisfy the following relationship: $-30 \leqq \sigma C_{max} \leqq -15$.

The panel 10 is formed by pressing the glass gob of about 1000° C. in a bottom mold of a mold set by means of a top mold (or plunger). And in a case where the pressed panel is cooled down naturally to a predetermined temperature, a tensile stress in the range of about 70 to about 80 MPa is imparted to the inner surfaces of the first to fourth corner portion 23*a* to 23*d* in the directions of the diagonal axes 17. On the other hand, if the pressed panel is cooled down by performing a normal annealing process in which the pressed panel is conveyed in an annealing lehr while holding the temperature thereof near the annealing point and controlling annealing time by adjusting the conveying speed, the tensile stresses at the inner surfaces of the first to fourth corner portions 23*a* to 23*d* in the directions of the diagonal axes 17 can be phenomenally reduced. However, such annealing process is almost impractical because the relatively long annealing time results in poor productivity.

Further, in a case where the pressed panel is conveyed at a higher conveying speed than that of the normal annealing process while holding the temperature of the annealing lehr at a strain point or below, a tensile stress in the range of about 20 to about 50 MPa is imparted to the inner surfaces of the first to the fourth corner portions 23*a* to 23*d* in the directions of the diagonal axes 17. The strain point is the temperature below which viscous flow cannot occur. By the way, according to modulus of rupture tests for determining the fracture strength of a panel by scratching surface of the panel with #150 aluminum oxide ($Al_2O_3$) emery paper, the fracture strength of the panel 10 is about 10 MPa. The tensile stress in the range of about 20 to about 50 MPa imparted to the inner surfaces of the first to the fourth corner portions 23*a* to 23*d* in the directions of the diagonal axes 17 is greater than the fracture strength of the panel 10, i.e., 10 MPa. So, in panels formed by the above-described method, even a little mechanical impact applied thereto can produce cracks and be a cause of breakage. In addition, these panels have a problem that tensile stress is imparted to the skirt portion and the blend radius portion of two short skirts and two long skirts thereby being unable to guarantee user's safety.

By performing a cooling process to be able to minimize tensile stresses at individual portions of the panel 10 including the inner surfaces of the first to fourth corner portions 23*a* to 23*d* before the pressed panel 10 is entered into the annealing lehr, the panel 10 of the present invention is manufactured in such a manner that the maximum compressive surface stress $\sigma C_{max}$ (MPa) of a surface including surface portions of the face portion 11 and the skirt portion 13 satisfies the following relationship: $-30 \leqq \sigma C_{max} \leqq -15$. Further, the tensile bending stress $\sigma bt$ (MPa) at the inner surface of the blend radius portion 14 satisfies the following relationship: $\sigma bt \leqq 10$; and the seal edge stresses $\sigma$ (MPa) of the first to fourth corner portions 23*a* to 23*d* where two short skirts 21 and two long skirts 22 meet, the following relationship: $-3.5 \leqq \sigma \leqq 3$.

Experiments

In Tables 1 and 2, the panels of embodiments 1 to 4 and comparative embodiments 1 to 9 are 17-inch size having an aspect ratio of 4:3 and the average outside curvature radius R equal to or greater than 10,000 mm. The panels of the embodiments 1 to 4 were subjected to the cooling process before being entered into the annealing lehr whereas the panels of the comparative embodiments 1 to 9 were not subjected to the cooling process. Further, in Tables 1 and 2, maximum temperatures of annealing lehr operation conditions 1 to 4 were set 430° C., 450° C., 460° C. and 470° C., respectively.

In Tables 1 and 2, the maximum compressive surface stresses $\sigma C_{max}$ (MPa) of a surface including surface portions of the face portion and the skirt portion were measured with a polarimeter using Senarmont method of photoelasticity prescribed in JIS (Japanese industrial standards)—S2305 after a panel having been cut. A minus sign (−) indicates compressive stress and a plus sign (+), tensile stress.

Further, scratch tests were performed on the panels of the embodiments 1 to 4 and the comparative embodiments 1 to 9 to determine to what extent they can endure mechanical impacts. In the scratch test, scratches were made on inner surfaces of first to fourth corner portions and an inner surface of a blend radius portion of two short skirts and two long skirts by a diamond scriber for cutting glass. And, in this test broken panels were determined to be disqualified. The results of the scratch tests are indicated in Tables 1 and 2.

In the scratch tests on the panels of the comparative embodiments 1 to 9, as soon as the scratches were made by the diamond scriber, self-cracking occurred. The tensile bending stresses σbt (MPa) of the blend radius portion for the panels of the comparative embodiments 1 to 9 were determined by fracture stresses using mirror radius, i.e., a half of a distance between two mist hackles appearing on a fracture surface. The fracture stress is determined by the following relationship:

$$\text{Fracture stress} = \text{Mirror constant}/(\text{Mirror radius})^{1/2} \qquad \text{Eq. 1}$$

The panels of the embodiments 1 to 4 were not broken in the scratch test. In such case, the tensile bending stress σbt (MPa) of the blend radius portion was measured quantitatively by using an electrical resistance strain gage. The tensile bending stress σbt (MPa) of the blend radius portion is a stress which tends to deform a skirt portion of a panel outwardly and which is vanished when the skirt portion is removed. Therefore, after the electrical resistance strain gage has been attached on an inner surface of a blend radius portion at which the tensile bending stress is to be measured, the skirt portion is removed, so that the amount of stress vanished after the removal of the skirt portion, i.e., the amount of stress present therein prior to the removal of the skirt portion, is measured by the electrical resistance strain gage. And the tensile bending stress is determined by using the stress present prior to the removal of the skirt portion.

Further, to determine whether the panel is broken or not during a sealing process of a panel and a funnel, lehr process simulation tests were performed in which, after inner surfaces of first to fourth corner portions of a panel had been scratched with #150 aluminum oxide emery paper, the panel was entered into a box-shaped electrical furnace. The temperature of the electrical furnace was held at a sealing temperature of the panel and the funnel and the results of these tests are indicated in Tables 1 and 2.

A water pressure test is performed with a panel and a funnel assembled. First, scratches are made on an outer surface of the panel by #150 aluminum oxide emery paper. Then, pressures in the inside and outside of a glass bulb are established at atmospheric pressure. Next, the pressure in the outside of the glass bulb is increased until the glass bulb is broken and, at this moment, the pressure in the outside of the glass bulb is measured. If this pressure is less than 35 psi, the glass bulb is determined disqualified.

TABLE 1

| ITEMS | EMBODIMENT 1 | EMBODIMENT 2 | EMBODIMENT 3 | EMBODIMENT 4 |
|---|---|---|---|---|
| FACE SHAPE | FLAT | FLAT | FLAT | FLAT |
| WEDGE RATE(Td/Tc) | 2.23 | 2.23 | 2.36 | 2.54 |
| Tc (mm) | 9.5 | 9.5 | 8.6 | 7.6 |
| Td (mm) | 21.2 | 21.2 | 20.3 | 19.3 |
| ANNEALING LEHR OPERATION CONDITION | CONDITION 2 | CONDITION 3 | CONDITION 4 | CONDITION 1 |
| COOLING PROCESS | ○ | ○ | ○ | ○ |
| MAXIMUM COMPRESSIVE SURFACE STRESS IN FACE (MPa) | −23.1 | −21.7 | −15.2 | −29.1 |
| MAXIMUM COMPRESSIVE SURFACE STRESS IN SKIRT (MPa) | −17.0 | −16.1 | −12.4 | −19.8 |
| TENSILE BENDING STRESS IN BRENDRADIUS | +8.8 | +8.5 | +7.4 | +9.5 |
| SCRATCH TEST IN 1ST TO 4TH CORNER | 0/4 | 0/4 | 0/4 | 0/4 |
| SCRATCH TEST IN SHORT AND LONG SKIRTS | 0/4 | 0/4 | 0/4 | 0/4 |
| LEHR PROCESS SIMULATION TEST | 0/4 | 0/4 | 0/4 | 0/4 |
| WATER PRESSURE TEST (psi) | 55 | 54 | 47 | 48 |

TABLE 2

| ITEMS | COMPARATIVE EMBODIMENT 1 | COMPARATIVE EMBODIMENT 2 | COMPARATIVE EMBODIMENT 3 | COMPARATIVE EMBODIMENT 4 | COMPARATIVE EMBODIMENT 5 | COMPARATIVE EMBODIMENT 6 | COMPARATIVE EMBODIMENT 7 | COMPARATIVE EMBODIMENT 8 | COMPARATIVE EMBODIMENT 9 |
|---|---|---|---|---|---|---|---|---|---|
| FACE SHAPE | FLAT | FLAT | FLAT | FLAT | FLAT | FLAT | FLAT | FLAT | FLAT |
| WEDGE RATE(Td/Tc) | 2.03 | 2.03 | 2.03 | 2.03 | 2.23 | 2.23 | 2.36 | 2.36 | 2.54 |
| Tc (mm) | 11.3 | 11.3 | 11.3 | 11.3 | 9.5 | 9.5 | 8.6 | 8.6 | 7.6 |
| Td (mm) | 23 | 23 | 23 | 23 | 21.2 | 21.2 | 20.3 | 20.3 | 19.3 |
| ANNEALING LEHR OPERATION CONDITION | CONDITION 1 | CONDITION 2 | CONDITION 3 | CONDITION 4 | CONDITION 1 | CONDITION 2 | CONDITION 1 | CONDITION 2 | CONDITION 1 |

TABLE 2-continued

| ITEMS | COMPARATIVE EMBODIMENT 1 | COMPARATIVE EMBODIMENT 2 | COMPARATIVE EMBODIMENT 3 | COMPARATIVE EMBODIMENT 4 | COMPARATIVE EMBODIMENT 5 | COMPARATIVE EMBODIMENT 6 | COMPARATIVE EMBODIMENT 7 | COMPARATIVE EMBODIMENT 8 | COMPARATIVE EMBODIMENT 9 |
|---|---|---|---|---|---|---|---|---|---|
| COOLING PROCESS | x | x | x | x | x | x | x | x | x |
| MAXIMUM COMPRESSIVE SURFACE STRESS IN FACE (MPa) | −24.4 | −17.0 | −16.1 | −15.4 | −22.9 | −22.2 | −24.5 | −24.3 | −25.4 |
| MAXIMUM COMPRESSIVE SURFACE STRESS IN SKIRT (MPa) | −22.3 | −14.8 | −13.4 | −11.8 | −18.4 | −16.2 | −18.3 | −15.2 | −18.1 |
| TENSILE BENDING STRESS IN BRENDRADIUS | +68.5 | +43.3 | +32.1 | +22.2 | +46.9 | +42.3 | +41.1 | +48.2 | +38.7 |
| SCRATCH TEST IN 1ST TO 4TH | 4/4 | 4/4 | 4/4 | 4/4 | 4/4 | 4/4 | 4/4 | 4/4 | 4/4 |
| CORNER SCRATCH TEST IN SHORT AND LONG SKIRTS | 4/4 | 4/4 | 4/4 | 4/4 | 4/4 | 4/4 | 4/4 | 4/4 | 4/4 |
| LEHR PROCESS SIMULATION TEST | 4/4 | 4/4 | 4/4 | 4/4 | 4/4 | 4/4 | 4/4 | 4/4 | 4/4 |
| WATER PRESSURE TEST (psi) | 69 | 63 | 66 | 60 | 54 | 56 | 51 | 55 | 47 |

As indicated in Table 1, the panels of the embodiments 1 to 4 have the wedge rate Td/Tc which satisfies the following relationship: $2.0 \leqq Td/Tc \leqq 2.6$; and a maximum compressive surface stress $\sigma C_{max}$ (MPa) of a surface including surface portions of the face portion and the skirt portion, which satisfies the following relationship: $-30 \leqq \sigma C_{max} \leqq -15$. Herein, although the maximum compressive surface stress of the skirt portion of the embodiment 3 in Table 1 is −12.4 MPa, the maximum compressive surface stress of the face portion is −15.2 MPa. Therefore, the maximum compressive surface stress of the panel of the embodiment 3 satisfies the following relationship: $-30 \leqq \sigma C_{max} \leqq -15$.

Further, the tensile bending stress σbt (MPa) at the inner surface of the blend radius portion satisfies the following relationship: $\sigma bt \leqq 10$. The panels of the embodiments 1 to 4 passed the scratch test on the first to fourth corner portions, the scratch test on the inner surface of the blend radius portion of two short skirts and two long skirts and the cathode ray tube lehr process simulation test.

Further, from the water pressure test for determining whether vacuum strength is guaranteed or not it was proved that the panels of the embodiments 1 to 4 satisfy the normal glass bulb design standard level in the range of about 2.5 to about 3 atm (1 atm=14.6956 psi) even though the fracture pressure is lessened as the wedge rate or weight reduction rate of the face portion is increased. Therefore, in the panels of the embodiments 1 to 4, the tensile stresses at the first to fourth corner portions can be reduced while achieving the vacuum strength of the glass bulb for the target weight reduction.

As indicated in Table 2, the panels of the comparative embodiments 1 to 9 whose tensile bending stresses σbt (MPa) at the inner surface of the blend radius portion were greater than 10 MPa were disqualified since they failed the scratch tests on the first to fourth corner portions, the scratch tests on the inner surface of the blend radius portion of two short skirts and two long skirts and the cathode ray tube furnace process simulation test.

Further, in panels 1 to 3 having the wedge rate Td/Tc which satisfies the following relationship: $2.0 \leqq Td/Tc \leqq 2.6$; a maximum compressive surface stress $\sigma C_{max}$ (MPa) which satisfies the following relationship: $-30 \leqq \sigma C_{max} \leqq -15$; and a tensile bending stress σbt (MPa) at the inner surface of the blend radius portion satisfies the following relationship: $\sigma bt \leqq 10$, angles for seal edge stresses were measured at such locations Pt1 to Pt15 along the periphery of the panel 10 as shown in FIG. 3, and the measured values are indicated in Table 3. The panels 1 and 2 in Table 3 have the same configuration and sizes as the panels of the embodiments 4 and 3, respectively. The panel 3 in Table 3 is a panel formed under an annealing lehr operation condition whose maximum temperature is greater than that of the annealing lehr operation condition 4, i.e., 470° C.

Glass bulb makers deal with seal edge stresses by means of angles, and the measured angles at the points Pt1 to Pt15 in Table 3 can be converted into seal edge stresses by using the following relationship:

$$\text{Stress}=(\text{Wave length}/180°)\times\text{Measured angle}/(\text{Photoelastic coefficient}\times\text{Thickness}) \quad \text{Eq. 2}$$

where the measured angle is a value when fringe disappears by rotating an analyzer of a polarimeter, and the photoelastic coefficient is varied according to composition of the panel.

Further, in cooling condition of Table 3, conditions 1 to 6 are different in cooling flow rate, cooling position, cooling time and cooling cycle. In the conditions 1 to 3, the cooling flow rate and the cooling position were the same whereas the cooling time in a predetermined cooling cycle of the condition 2 was longer than that of the condition 1 and shorter than that of the condition 3. Similarly, in the conditions 4 and 6, the cooling flow rate and the cooling position were the same whereas the cooling time in a predetermined cooling cycle of the condition 5 was longer than that of the condition 4 and shorter than that of the condition 6. And the cooling cycle of the conditions 1 to 3 were different from that of the conditions 4 and 6. The cooling level of the conditions 3 and 6 was greatest. Further, after cooling process has been completed the panels 1 and 2 have the maximum compressive surface stress which satisfies the following relationship: $-30 \leqq \sigma C_{max} \leqq -15$. The panel 3 has the maximum compressive surface stress which is greater than −15 MPa.

and 6 for individual panels 1 to 3, and values of seal edge stresses of the first to fourth corner portions are increased, i.e., express the trend toward the tensile stress, as the cooling time becomes longer. The panels of the embodiments 5 to 17 whose seal edge stresses σ (MPa) of the first to fourth corner portions satisfy the following relationship: $-3.5 \leqq \sigma \leqq 3$, i.e., $-25° \leqq$ measured angle $\leqq 20°$, passed the scratch test. In contrast, the panels of comparative embodiments 10 to 17 whose seal edge stress σ (MPa) of the first to fourth corner portions did not satisfy the following relationship: $-3.5 \leqq \sigma \leqq 3$ failed the scratch test.

As described above, the panel of the present invention is capable of preventing breakage of a glass bulb due to tensile stress and guaranteeing standards required by the scratch test, cathode ray tube furnace process simulation test and

TABLE 3

| | | | PERYPHERY (°) | | | | | | | | SCRATCH TEST | |
|---|---|---|---|---|---|---|---|---|---|---|---|---|
| | ITEMS | COOLING CONDITION | Pt 1 | Pt 3 | Pt 5 | Pt 7 | Pt 9 | Pt 11 | Pt 13 | Pt 15 | FRACTURE STRESS | BREAKAGE |
| PANEL 1 | COMPARATIVE EMBODIMENT 10 | NO COOLING | −260 | −85 | −200 | −75 | −245 | −75 | −200 | −85 | OVER 10 | ○ |
| | COMPARATIVE EMBODIMENT 11 | CONDITION 1 | −152 | −55 | −99 | −53 | −140 | −57 | −93 | −58 | OVER 10 | ○ |
| | COMPARATIVE EMBODIMENT 12 | CONDITION 2 | −150 | −45 | −100 | −42 | −144 | −47 | −107 | −47 | OVER 10 | ○ |
| | COMPARATIVE EMBODIMENT 13 | CONDITION 3 | −158 | −29 | −86 | −32 | −146 | −25 | −90 | −30 | OVER 10 | ○ |
| | COMPARATIVE EMBODIMENT 14 | CONDITION 5 | −154 | −30 | −94 | −26 | −149 | −22 | −87 | −32 | OVER 10 | ○ |
| | EMBODIMENT 5 | CONDITION 4 | −137 | −14 | −67 | −18 | −147 | −8 | −77 | −18 | BELOW 10 | x |
| | EMBODIMENT 6 | CONDITION 6 | −140 | 15 | −60 | 0 | −150 | 9 | −61 | 8 | BELOW 10 | x |
| PANEL 2 | COMPARATIVE EMBODIMENT 15 | NO COOLING | −130 | −85 | −215 | −47 | −125 | −45 | −105 | −48 | OVER 10 | ○ |
| | COMPARATIVE EMBODIMENT 16 | CONDITION 1 | −88 | −37 | −66 | −31 | −75 | −34 | −58 | −35 | OVER 10 | ○ |
| | COMPARATIVE EMBODIMENT 17 | CONDITION 2 | −85 | −30 | −56 | −31 | −72 | −30 | −60 | −32 | OVER 10 | ○ |
| | EMBODIMENT 7 | CONDITION 3 | −91 | −20 | −53 | −23 | −88 | −20 | −45 | −23 | BELOW 10 | x |
| | EMBODIMENT 8 | CONDITION 4 | −95 | −18 | −48 | −25 | −86 | −22 | −54 | −20 | BELOW 10 | x |
| | EMBODIMENT 9 | CONDITION 5 | −84 | −18 | −37 | −15 | −80 | −18 | −49 | −13 | BELOW 10 | x |
| | EMBODIMENT 10 | CONDITION 6 | −75 | 4 | −35 | 0 | −70 | 2 | −30 | 0 | BELOW 10 | x |
| PANEL 3 | EMBODIMENT 11 | NO COOLING | −67 | −22 | −59 | −21 | −57 | −19 | −56 | −22 | BELOW 10 | x |
| | EMBODIMENT 12 | CONDITION 1 | −50 | −23 | −40 | −15 | −42 | −18 | −37 | −17 | BELOW 10 | x |
| | EMBODIMENT 13 | CONDITION 2 | −48 | −25 | −35 | −22 | −41 | −21 | −28 | −20 | BELOW 10 | x |
| | EMBODIMENT 14 | CONDITION 3 | −47 | −17 | −31 | −17 | −45 | −14 | −34 | −15 | BELOW 10 | x |
| | EMBODIMENT 15 | CONDITION 4 | −46 | −18 | −27 | −12 | −42 | −10 | −30 | −13 | BELOW 10 | x |
| | EMBODIMENT 16 | CONDITION 5 | −44 | −10 | −28 | −12 | −40 | −12 | −32 | −13 | BELOW 10 | x |
| | EMBODIMENT 17 | CONDITION 6 | −47 | 0 | −27 | 0 | −44 | 0 | −26 | 0 | BELOW 10 | x |

As indicated in Table 3, at the same location (any one of points Pt1 to Pt15) for the panels 1 to 3, absolute value of seal edge stress of the panel 2 is less than that of the panel 1, and greater than that of the panel 3. Moreover, the seal edge stress for each location varies according to the cooling condition. The cooling level was greatest in the conditions 3 water pressure test. Further, mechanical strength of the panel of the present invention is reinforced, so that weight reduction of a glass bulb can be readily accomplished.

While the invention has been shown and described with respect to the preferred embodiments, it will be understood by those skilled in the art that various changes and modifications may be made without departing from the spirit and scope of the invention as defined in the following claims.

What is claimed is:

1. A panel for use in a cathode ray tube, comprising:

a face portion for displaying picture images, the face portion having first to fourth corner portions;

a skirt portion extending backward from a perimeter of the face portion; and a blend radius portion joining the skirt portion to the face portion, wherein average outside curvature radius R (mm) of the face portion satisfies the following relationship: $R \geqq 10,000$; wedge rate Td/Tc of the face portion satisfies the following relationship: $2.0 \leqq Td/Tc \leqq 2.6$; maximum compressive surface stress $\sigma C_{max}$ (MPa) of the face portion and the skirt portion satisfies the following relationship: $-30 \leqq \sigma C_{max} \leqq -15$; and tensile bending stress $\sigma bt$ (MPa) at inner surface of the blend radius portion satisfies the following relationship: $\sigma bt \leqq 10$.

2. The panel of claim 1, wherein seal edge stresses $\sigma$(MPa) of the first to fourth corner portions satisfy the following relationship: $-3.5 \leqq \sigma \leqq 3$.

* * * * *